United States Patent [19]

Mauderer et al.

[11] Patent Number: 4,741,280

[45] Date of Patent: May 3, 1988

[54] SAFETY HOOK FOR TRAPEZE HARNESSES, IN PARTICULAR FOR WINDSURFERS

[75] Inventors: Werner Mauderer, Lindenberg; Utz Kador, Starnberg, both of Fed. Rep. of Germany

[73] Assignee: Peter Brockhaus GmbH & Co., Handels KG, Eurasburg, Fed. Rep. of Germany

[21] Appl. No.: 811,323

[22] Filed: Dec. 19, 1985

Related U.S. Application Data

[63] Continuation of Ser. No. 582,537, Feb. 22, 1984, abandoned, which is a continuation of Ser. No. 382,576, May 27, 1982, abandoned.

[30] Foreign Application Priority Data

Jun. 3, 1981 [DE] Fed. Rep. of Germany ... 8116416[U]
Aug. 11, 1981 [DE] Fed. Rep. of Germany ..... 3131722
Oct. 20, 1981 [DE] Fed. Rep. of Germany ..... 3141582

[51] Int. Cl.[4] ..... B63B 35/00

[52] U.S. Cl. ..... 114/39.2; 182/3; 24/230.5 W

[58] Field of Search ..... 114/113, 270, 39, 253; 24/230.5 W, 230.5 R, 230 AP, 3 L, 369, 129 C, 201 TR, 78, 230 A, 230 AS; D8/367; 280/290; 182/3, 4, 9; 294/151 A, 151 R, 151 B; 54/6, 17, 69; 119/96; 128/134

[56] References Cited

U.S. PATENT DOCUMENTS

| | | | |
|---|---|---|---|
| 404,615 | 6/1889 | Giroux | 24/230.5 R |
| 468,574 | 2/1892 | Moore | 182/4 |
| 474,675 | 5/1892 | Milne | 24/230.5 R |
| 601,530 | 3/1898 | Singleton | 280/290 |
| 1,025,964 | 5/1912 | Costuma | 24/230.5 R |
| 1,446,781 | 2/1923 | Benson | 24/230.5 R |
| 1,526,240 | 2/1925 | Saylor | 24/230.5 R |
| 1,843,507 | 2/1932 | Elder | 24/230.5 R |
| 1,879,817 | 9/1932 | Nelson | 24/230.5 R |
| 3,403,750 | 10/1968 | Pomagalski | 182/3 |
| 3,458,188 | 7/1969 | Infante | 182/4 |
| 4,112,865 | 9/1978 | Carn | 24/230 AP |
| 4,140,205 | 2/1979 | Matson | 182/3 |

FOREIGN PATENT DOCUMENTS

| | | | |
|---|---|---|---|
| 2835579 | 2/1980 | Fed. Rep. of Germany | 114/39 |
| 2837534 | 3/1980 | Fed. Rep. of Germany | 114/39 |
| 2940605 | 4/1981 | Fed. Rep. of Germany | 24/774 |
| 2936448 | 5/1982 | Fed. Rep. of Germany | 24/230.5 R |

OTHER PUBLICATIONS

Surf Magazine, Aug. 1978; pp. 35–40.
Surf Magazine, Aug. 1981; pp. 27–36.
Surf Magazine, Jul. 1982; pp. 88–89.

*Primary Examiner*—John J. Wilson
*Attorney, Agent, or Firm*—Sandler & Greenblum

[57] ABSTRACT

A safety hook for trapeze harnesses, in particular for wind-surfers, comprising a clevis hook attached to a hook plate to receive the trapeze rope, whereby the clevis hook is designed in such a way that it exhibits a wide contact area for the trapeze rope. In this way, winding of the rope around the hook is avoided.

19 Claims, 1 Drawing Sheet

SAFETY HOOK FOR TRAPEZE HARNESSES, IN PARTICULAR FOR WINDSURFERS

Figure 1:
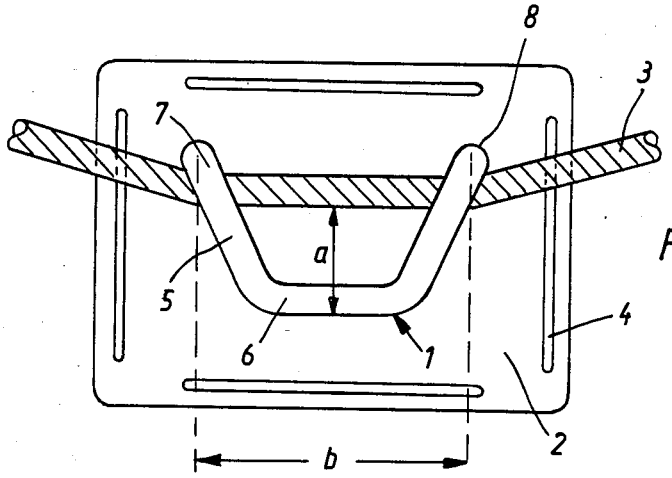

This application is a continuation of application Ser. No. 582,537, filed Feb. 22, 1984 now abandoned, which is a continuation of application Ser. No. 382,576 filed May 27, 1982, now abandoned.

The present invention relates to a safety hook for trapeze harnesses.

Trapeze harnesses are mainly used, in particular by wind-surfers, to faciliatate gripping. However, trapeze harnesses are also used in the sport of sailing. The trapeze harness encompasses the sportsman's torso. In the chest area there is usually a hook-shaped device with which the sportsman can hitch himself detachably to the rigging of the wind-surfer or to parts of the sailboat. In the case of a wind-surfer he usually hitches himself to a rope, the so-called "trapeze rope", lossely attached to the wishbone boom, or to the wishbone boom itself.

The known trapeze harnesses are disadvantageous in that in case of a fall, in particular a hurl or twisting fall, the trapeze rope can wind around the hook of the trapeze harness and can then only be pulled off the hook with difficulty. This can put the sportsman in an extremely dangerous situation.

Trapeze hooks are also known which encounter this danger by involving additional devices to increase their safety. Hooks are known, for example, which open up when a rip cord is pulled so that the rope can be removed more easily. The obvious disadvantage of this kind of safety hook is its elaborate construction and susceptibility to disturbance, since the trapeze harness is exposed to great stress and environmental influences such as salt water and sand.

The problem of the invention is thus to provide a safety hook for trapeze harnesses such that the trapeze rope or similar device cannot wind around the hook or this danger is at least reduced, and the rope can be easily slipped off, if desired.

The invention is based on the finding that this problem can be solved in a simple way by a spcial geometrical design of the hook.

The subject-matter of the invention is a safety hook for trapeze harnesses, in particular for wind-surfers, which comprises a clevis hook attached to a hook plate to receive the trapeze rope, and is characterized in that the clevis hook exhibits a wide contact area for the trapeze rope.

The clevis hook was made of round steel wire in the case of the hooks known up to now. This resulted in a very small, almost punctiform contact area for the rope. Instead, a wide contact area for the trapeze rope is proposed on the clevis hook according to the invention.

The wide contact area allows for a geometrical design of the hook which ensures that the trapeze rope cannot wind around the hook, or at least this danger is reduced, and the rope can be easily slipped off over a remainder contact surface even under tensile stress, or slips off by itself when pulld on.

The contact area is preferably more than 10 mm wide and is usually between 20 and 70 mm, in particular 30 to 50 mm wide. The values stated refer to the hook sizes which are usual today; but since the geometry of the clevis hook itself leads to the advantages according to the invention, as shall be explained in more detail below, the values stated can be larger or smaller depnding on whether the hook is larger or smaller.

According to a preferred embodiment, contact area b should be larger than the projection of length a of hook tongue 5 onto hook plate 2.

If this condition is fulfilled, the hook turns free of trapeze rope 3 when turned around the perpendicular to hook plate 2 as the axis of rotation, which means that the trapeze rope cannot wind around the hook during a twist fall. In order to make sure the hook is freed during turning, it is advantageous to design the length of the hook tongue considerably smaller than the width of the contact area. This is also advisable because in practice turning takes place on varying spatial planes and not only on the ideal vertical plane. The contact area is formed by at least two separated distinct contact points between which the rope extends during use. The at least two separated distinct contact points lie on a line located between an interior surface of the tongue and the hook plate. The geometry of the hook should also take these facts into consideration, which is accomplished in particular when contact area b is 1.2 to 2 times length a of hook tongue 5.

On the other hand, the trapeze rope—at least in most cases—does not wind around the hook area even when its length is slightly larger than its contact area, so that such embodiments as these also exhibit the advantages according to the invention, at least in part.

If hook tongue 5 is arranged parallel to hook plate 2, the length of hook tongue 5, in th above-mentioned preferred embodiment, must be shorter than the width of clevis hook 1 at the point where trapeze rope 3 is held in its normal state. In the case of trapeze ropes that are usually directed somewhat upwards, this is the area where the hook is most curved. This area where the rope is held is the important one as far as the width of the hook is concerned, because this is where the hook turns around the rope, and not the width of the hook at its base where it is attached to the hook plate.

The length of the hook tongue is defined as the distance on the perpendicular between trapeze rope 3 or the contact area where the trapeze rope is held by the hook, and the front end 6 of the hook. This is the length which must be turnd free of the rope during turning.

It also depends on the angle between hook tongue 5 and hook plate 2 whether the hook is turned free of the rope or the rope winds around the hook. If hook tongue 5 is inclined away from hook plate 2 at an angle, the hook can be more easily turned out of the trapeze harness. It is assumed that there is a dependence here according to a trigonometric function. In any case the relation is fulfilled when the projection of the length of hook tongue 5 onto hook plate 2 is smaller than the width of the hook. This means that the hook can be less wide when the hook tongue is inclined away from the hook plate.

Conversely, one may consider inclining hook tongue 5 towards hook plate 2. This embodiment involves the disadvantage that it is more difficult to remove the hook from the rope or, in other words, the hook must be wider. This is similarly dependent on the angle of inclination, and it is assumed that the same trigonometric function, although inverted, is valid here as for the hook inclined away from the hook plate. In this embodiment, the hook must be wider than in those embodiments in which the hook tongue is arranged parallel to the hook plate or away from the latter. However, this embodiment involves the advantage that the trapeze rope is held in its position to a large extent and does not slide downwards, which is advantageous in practice.

The back portion 7 of the hook need not be perpendicular to the hook plate, but can also be directed upwards or downwards.

The clevis hook preferably exhibits a tapering, preferably constantly tapering, profile in its projection onto the plane of hook plate 2 in the direction of its front end 6.

This geometrical design can also be realized independently of the above-mentioned features, however. The tapering profile involves the great advantage that a trapeze rope that has wound around the clevis hook can easily be removed by hand, even under tensile force, or slips off by itself under the effect of corresponding forces. A tapering profile of the hook is only possible in the case of the wide contact area provided according to the invention.

The clevis hook preferably exhibits a profile that tapers at an angle of 20° to 40°, preferably 30°. The angle referred to is that between the two sides or arms of the clevis hook.

The hook can have a wide variety of shapes or combination of shapes when seen from the top and from the side. When seen from the top, the hook can taper towards its front end 6, as already mentioned. This can be constant or continuous. The tapering can also be slight from base 8 up to the area where the trapeze rope is held, however, and then increase towwards front end 6. The portion between the hook plate and the contact area for the trapeze rope, however, can also have a constant width. The hook can also have a constant width from base 8 to front end 6. One may also consider making the hook wider at its front end 6 than where trapeze rope 3 is held. An embodiment such as this is advantageous in that the trapeze rope is held in the hook better and does not fall downwards as easily. Further, the tapering or widening of the hook towards its front end can have a concave or convex shape.

The front end 6 of the hook is preferably rounded off or flattened. When seen from the side, hook tongue 5 can be straight or bent, for example, in the shape of an inverted "S". The portion between the hook plate and the contact area can also be straight, inclined upwardly or downwardly or curved.

The size of the hook and the end radii naturally depend on its application, and must in particular be adapted to the diameter of the trapeze rope.

The distance between the front end 6 of the hook and hook plate 2 must be large enough to facilitate hitching the hook into the rope. This distance c preferably ranges from 0.5 to 5 cm and is in particular approximately 2 cm.

In the following, the invention shall be described in more detail with reference to the drawing, which shows an exemplary embodiment. The figures show:

FIG. 1 a top view of the safety hook

Figure 2:
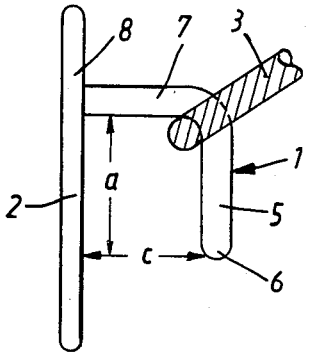

FIG. 2 a side view of the hook shown in FIG. 1.

FIG. 1 shows a hook 1 formed by an accordingly bent clevis attached to a hook plate 2. Hook plate 2 can be attached to the trapeze in the usual manner by means of mounting straps (not shown) directed through slots 4. Clevis hook 1 grips trapeze rope 3. In another embodiment of the invention the clevis hook can be pivotably mounted on the hook plate.

FIG. 2 shows a side view which shows distances a and c especially clearly. In the embodiment shown, the hook consists of a bent portion with a round diameter wire which is connected with hook plate 2 in an appropriate manner, for example welded to it or screwed onto it or such that an extension of same is cast in the hook plate.

Hook 1 can be designed not as a clevis, however, but in the shape of a tongue forming an integral unit with hook plate 2 or connected with the latter in an appropriate manner.

Preferred materials for hook 1, also in the embodiment as a bracket, and hook plate 2 are plastics and metals, in particular stainless steel, and combinations of these materials.

Clevis hook 1 can also be pivoted on hook plate 2 according to a further embodiment. This can be achieved, for example, when the clevis hook forms a self-contained element connected with the hook plate, for example, by a pivoted bolt.

Alternatively, the hook, in one of the embodiments described in detail, can be attached to a portion pivoted to hook plate 2.

The safety hook according to the invention was described above along with a usual hook plate. However, it is obvious that the invention relating to the geometry of the hook can also be realized without the described hook plate. In other words, it is not essential to the invention how the sportsman is attached to the safety hook. The term "hook plate" is thus intended in its most general sense in connection with the present invention.

Similarly, the safety hook according to the invention was essentially described with respect to the trapeze ropes that are usual today. Obviously, here too the term "trapeze rope" is intended in a general sense and also embraces similar devices.

We claim:

1. A safety trapeze harness system for sailboards operatively associated with a trapeze rope loosely attached to a wishbone comprising:

(a) a clevis hook for receiving a trapeze rope, said clevis hook having a tongue comprising a contact area formed by at least two separated distinct contact points between which said rope extends and is held during use and a remainder contact suface of said tongue over which said rope passes as it slides off of said clevis hook, said contact area being at least as wide as the remainder contact surface;

(b) a hook plate;

(c) means on said hook plate for attaching said clevis hook to an operator of said sailboard; and wheein said clevis hook is attached to said hook plate at one end, and is free at its other end to allow for release of said trapeze rope, and wherein the perpendicular projection of said remainder contact surface on said hook plate tapers towards the free end of said clevis hook.

2. The safety trapeze harness system as defined by claim 1 wherein said clevis hook is mounted on said hook plate at one end, and wherein said contact area is wider than the projection of the length of the hook tongue onto the hook plate, in a direction from the end at which said tongue is connected to said hook plate to a free end of said clevis hook.

3. The safety trapeze harness system as defined by claim 2 wheein the contact area is 1.2–2 times the length of the hook tongue projection.

4. The safety trapeze harness system as defined by claim 1 wherein said hook tongue projects in front of said hook plate by a distance of 0.5–5 cm.

5. The safety trapeze harness system as defined by claim 1 wherein said hook tongue is inclined at an angle relative to said hook plate.

6. The safety trapeze harness system as defined by claim 1 wherein the projection of said remainder contact surface has a constant taper.

7. The safety trapeze system as defined by claim 6 wherein the projection of said remainder contact surface has a taper of 20°–40°.

8. The safety trapeze harness system as defined by claim 1 wherein said clevis hook is pivotably mounted on said hook plate.

9. The safety trapeze harness system as defined by claim 1 wherein said hook plate is adapted to be secured substantially parallel to the body of said operator, and wherein said clevis hook comprises a first projecting part connected to and projecting away from said hook plate and said tongue is connected to extend along its length from the first projecting part to a free end of said tongue furthest from said first projecting part, and disposed at an angle relative to said first part, said contact area having a width which is at least approximately 1.2 times the length of the orthogonal projection of said tongue onto a plane which is substantially perpendicular to said first part.

10. The safety trapeze harness system as defined by claim 1 wherein said hook plate comprises cutouts therein whereby a body harness belt may be slid through said cutouts for securing said harness system to a wearer.

11. The safety trapeze harness system as defined by claim 1 wherein said clevis hook is formed by a wire hook.

12. The safety trapeze harness system as defined by claim 1 wherein said clevis hook is formed by a bracket.

13. A safety trapeze harness system for sailboards, comprising:

(a) a clevis hook for receiving a trapeze rope, said clevis hook having a tongue comprising a contact area formed by at least two separated distinct contact points between which said rope extends and is held during use and a remainder contact surface of said tongue over which said rope passes as it slides off of said clevis hook, said contact area being at least as wide as the remainder contact surface, wherein said contact area is greater than 10 mm;

(b) a hook plate;

(c) means on said hook plate for attaching said clevis hook to an operator of said sailboard; and wherein said clevis hook is attached to said hook plate at one end, and is free at its other end to allow for release of said trapeze rope, and wherein said remainder contact surface tapers towards the free end of said clevis hook.

14. The safety trapeze harness system as defined by claim 13 wherein said contact area is 20–70 mm. wide.

15. The safety trapeze harness system as defined by claim 13 wherein said contact area is 30–50 mm. wide.

16. A safety trapeze harness system for sailboards, comprising:

(a) a hook plate;

(b) a clevis hook for receiving a trapeze rope, said clevis hook having a tongue comprising a contact area formed by at least two separated distinct contact points between which said rope extends during use, said tongue having a non-constant width whose perpendicular projection onto the hook plate varies along the length of said tongue to facilitate release of said rope without said rope becoming caught on said hook in the event of a fall;

wherein said width of said tongue from a frontal view thereof is wider at one end than at its other end and varies from one end to the other end of said tongue to form a projection on said hook plate having a taper angle of 20°–40°;

(c) means on said hook plate for attaching said clevis hook to an operator of said sailboard; and wherein said clevis hook is attached to said hook plate at one end, and is free at its other end to allow for release of said trapeze rope, and wherein said clevis hook on said hook plate tapers towards the free end of said clevis hook.

17. A safety trapeze harness system for sailboards comprising:

(a) a hook plate;

(b) a clevis hook for receiving a trapeze harness, said clevis hook having a rope contact area formed by at least two separated distinct contact points between which said rope extends during use, said rope contact area having a width of at least approximately 10 mm;

(c) means on said hook plate for attaching said clevis hook to an operator of said sailboard and wherein said clevis hook is attached to said hook plate at one end, and is free at its other end to allow for release of said trapeze rope, and wherein said clevis hook on said hook plate tapers towards the free end of said clevis hook.

18. A safety trapeze harness system for sailboards, comprising:

(a) a hook plate;

(b) a clevis hook for receiving a trapeze rope, said clevis hook having a tongue comprising a contact area formed by at least two separated distinct contact points between which said rope extends and is held during use and a remainder contact surface of said tongue over which said rope passes as it slides off of said clevis hook, said contact area being at least as wide as the remainder contact surface;

wherein said at least two separated distinct contact points lie on a line located between a surface of said tongue facing said hook plate and said hook plate;

(c) means on said hook plate for attaching said clevis hook to an operator of said sailboard; and wherein said clevis hook is attached to said hook plate at one end, and is free at its other end to allow for release of said trapeze rope, and wherein the perpendicular projection of said remainder contact surface on said hook plate tapers towards the free end of said clevis hook.

19. A safety trapeze harness system for sailboards comprising:

(a) a hook plate;

(b) a clevis hook for recieving a trapeze rope, said clevis hook having a tongue comprising a contact area formed by at least two separated distinct contact points between which said rope extends and is held during use and a remainder contact surface of said tongue over which said rope passes as it slides off of said clevis hook;

(c) means on said hook plate for attaching said clevis hook to an operator of said sailboard; and wherein said clevis hook is attached to said hook plate at one end and is free at its other end, and comprises a portion extending from said attached one end to a bend and a portion extnding from said bend to said free end, and wherein the perpendicular projection of said remainder contact surface on said hook plate tapers from the bend towards the free end.

* * * * *